US008311248B2

(12) United States Patent
Bai et al.

(10) Patent No.: US 8,311,248 B2
(45) Date of Patent: Nov. 13, 2012

(54) PIEZOELECTRIC PANEL SPEAKER AND OPTIMAL METHOD OF DESIGNING THE SAME

(75) Inventors: Mingsian R. Bai, Hsinchu (TW); Yao-Kun Tsai, Taoyuan County (TW)

(73) Assignee: National Chiao Tung University, Hsinchu (TW)

( * ) Notice: Subject to any disclaimer, the term of this patent is extended or adjusted under 35 U.S.C. 154(b) by 0 days.

(21) Appl. No.: 13/447,366

(22) Filed: Apr. 16, 2012

(65) Prior Publication Data

US 2012/0203526 A1 Aug. 9, 2012

Related U.S. Application Data

(62) Division of application No. 12/749,796, filed on Mar. 30, 2010.

(30) Foreign Application Priority Data

Jan. 15, 2010 (TW) ..... 99101080 A

(51) Int. Cl.
*H04R 25/00* (2006.01)

(52) U.S. Cl. ..... 381/190

(58) Field of Classification Search ..... 381/190
See application file for complete search history.

(56) References Cited

U.S. PATENT DOCUMENTS

| | | | | |
|---|---|---|---|---|
| 7,151,837 | B2 | 12/2006 | Bank et al. | |
| 7,302,068 | B2 | 11/2007 | Longbottom et al. | |
| 2004/0070312 | A1 * | 4/2004 | Penunuri et al. | 310/313 A |
| 2007/0147650 | A1 * | 6/2007 | Lee et al. | 381/396 |
| 2009/0205179 | A1 * | 8/2009 | Kobayashi | 29/25.35 |
| 2010/0024198 | A1 * | 2/2010 | Chen et al. | 29/594 |
| 2010/0232635 | A1 * | 9/2010 | Miyazaki et al. | 381/336 |
| 2010/0317420 | A1 * | 12/2010 | Hoffberg | 463/1 |
| 2011/0038495 | A1 * | 2/2011 | Jeong et al. | 381/190 |
| 2011/0135123 | A1 * | 6/2011 | Kim et al. | 381/190 |
| 2011/0182450 | A1 * | 7/2011 | Chung et al. | 381/190 |

OTHER PUBLICATIONS

Mingsian R. Bai; Yenchih Lu; Optimal Implementation of Miniature Piezoelectric Panel Speakers Using the Taguchi Method and Genetic Algorithm; Journal of Vibration and Acoustics, Jul. 2004, vol. 126, pp. 359-369.

Mingsian R. Bai, Bowen Liu; Determination of Optimal Exciter Deployment for Panel Speakers Using the Genetic Algorithm; Journal of Sound and Vibration 269 (2004) 727-743.

Mingsian R. Bai, Chinghong Huang; Optimization and Implementation of Piezoelectric Radiators Using the Genetic Algorithm; J. Acoust. Soc. Am. 113 (6), Jun. 2003, 3197-3208.

* cited by examiner

*Primary Examiner* — Forrest M Phillips
(74) *Attorney, Agent, or Firm* — Rosenberg, Klein & Lee

(57) ABSTRACT

A piezoelectric panel speaker and an optimal method of designing the same is disclosed. In the structure of the speaker, at least one piezoelectric plate attached at a surrounding frame supports a diaphragm inside the surrounding frame. A spacer is inserted between the piezoelectric plate and the diaphragm. The structure of the piezoelectric plates fixed at the surrounding frame improves the speaker performance within the low frequency range. The finite element method is employed to build a mathematical model to simulate the sound pressure loading of the piezoelectric panel speaker. Also, the simulated annealing method is employed to approach the optimal design parameters of the speaker structure.

8 Claims, 11 Drawing Sheets

PIEZOELECTRIC PANEL SPEAKER AND OPTIMAL METHOD OF DESIGNING THE SAME

RELATED APPLICATIONS

This application is a Divisional patent application of co-pending application Ser. No. 12/749,796, filed on 30 Mar. 2010, now pending. The entire disclosure of the prior application Ser. No. 12/749,796, from which an oath or declaration is supplied, is considered a part of the disclosure of the accompanying Divisional application and is hereby incorporated by reference.

BACKGROUND OF THE INVENTION

1. Field of the Invention

The present invention relates to a speaker, particularly to a piezoelectric panel speaker and an optimal method of designing the same.

2. Description of the Related Art

Piezoelectric materials have found applications in many areas of sensors and actuators since the discovery of piezoelectricity by Curie brothers a century ago. However, it was not until recently that designers started to explore the possibility of using it as a driving mechanism for panel speakers, e.g., Taiyo Yudan, Murata, NXT, etc. One advantage of such devices is that the electroacoustic efficiency of piezoelectric materials is considerably higher than their voice-coil counterpart.

In the panel speaker of the prior art, piezoelectric materials are directly attached to a diaphragm, and the diaphragm is bound with a surrounding frame disposed on a case of the panel speaker. For consolidating the whole structure, the diaphragm supported by the piezoelectric materials is bound very tightly with the surrounding frame. Therefore, the structure of the panel speaker does not easily collapse. The performance of the prior art panel speaker within the low frequency range is not satisfactory due to the fact that the stiffness of the panel speaker is hard. Thus, the piezoelectric panel speaker is applied to a treble unit speaker such as a buzzer.

Lee and White applied additional layers onto cantilever acoustic devices to reduce the fundamental frequency and improve acoustic output. Woodard used tailoring vibration response, vibration topography, acoustic chamber and tailoring damping to improve the acoustic performance. Chu et al. optimized the shape of the piezoelectric plate to reduce the fundamental frequency. Various approaches such as the genetic algorithm and Taguchi method dealing with optimal design were reported in writings. However, up to now, there are no panel speakers effectively improving acoustic output at lower frequency.

In view of the problems and shortcomings of the prior art, the present invention provides a new configuration of piezoelectric panel speaker and an optimal design method of designing the same, which discloses a new piezoelectric panel speaker structure and a simulated platform for frequency response, so as to solve the afore-mentioned problems of the prior art.

SUMMARY OF THE INVENTION

An objective of the present invention is to provide a piezoelectric panel speaker and an optimal design method of designing the same, which fixes at least one cantilever piezoelectric plate at a surrounding frame of the piezoelectric panel speaker, so as to support a diaphragm. This structure results in a different boundary effect and increases the frequency range.

Another objective of the present invention is to provide a piezoelectric panel speaker and an optimal design method of designing the same, which establishes a mathematical model and obtains an optimal design parameter for the piezoelectric panel speaker by utilizing a simulated annealing method. The optimal design parameter is helpful to a skilled person in the art to design the piezoelectric panel speaker.

To achieve the abovementioned objectives, the present invention provides a piezoelectric panel speaker comprising a surrounding frame and at least one piezoelectric plate attached on the surrounding frame. An end of the piezoelectric plate is fixed at the surrounding frame, and the another end of the piezoelectric plate extends toward the center of the surrounding frame. A diaphragm is supported by the piezoelectric plate whereby the diaphragm is disposed inside the surrounding frame.

The present invention discloses an optimal design method of the piezoelectric panel speaker, which comprises steps of: using the finite element method to establish a piezoelectric panel speaker model and calculating a strain energy and a kinetic energy of the piezoelectric plate, the diaphragm, and a spacer in the piezoelectric panel speaker by the finite element method in conjunction with the energy method, so as to establish a mathematical model of the piezoelectric panel speaker. The modulation of at least one variable parameter used in the mathematical model corresponds to the piezoelectric panel speaker structure, and an acoustic loading of the piezoelectric panel speaker structure is predicted by the mathematical model. The method continues with finding an optimal solution of the variable parameter by a simulated annealing method and obtaining an optimal variable parameter which corresponds to the piezoelectric panel speaker structure possessing an optimal sound pressure loading.

Following, the embodiments are described in detail in cooperation with the drawings to make easily understood the characteristics, technical contents and accomplishments of the present invention.

DETAILED DESCRIPTION OF THE INVENTION

Figure 1:
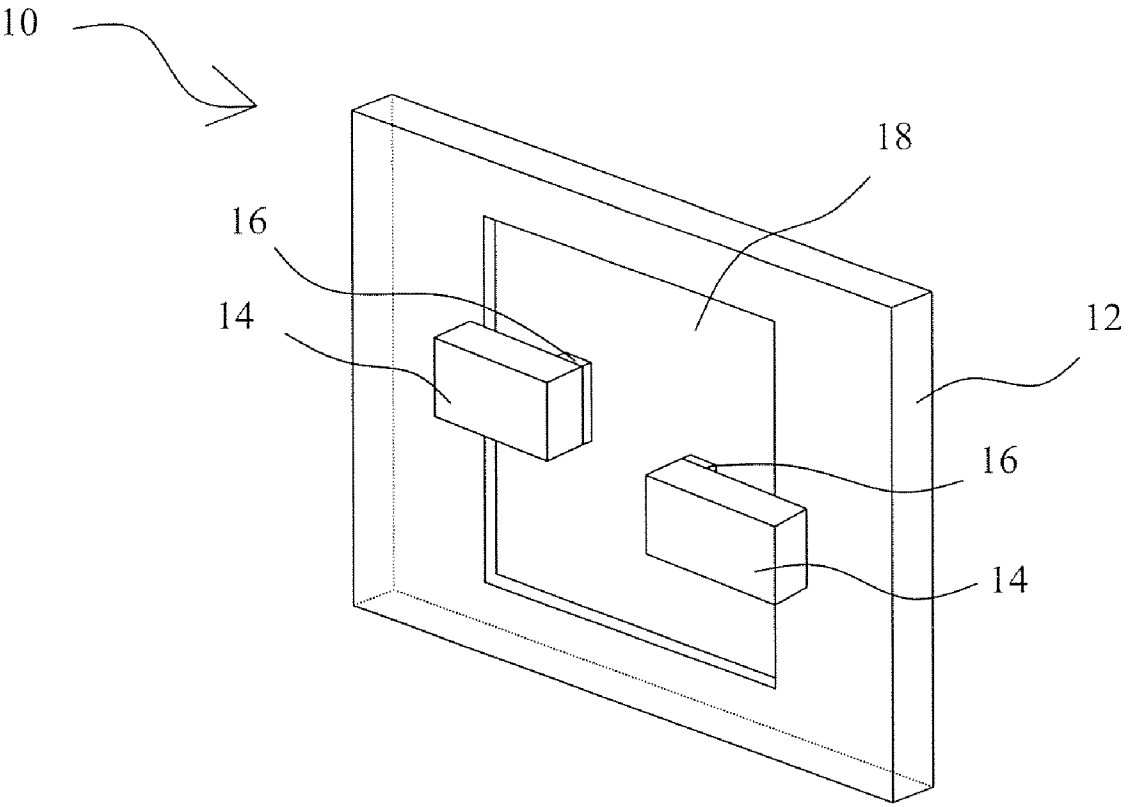
FIG. 1 is a perspective view showing a piezoelectric panel speaker according to an embodiment of the present invention.
Figure 2:
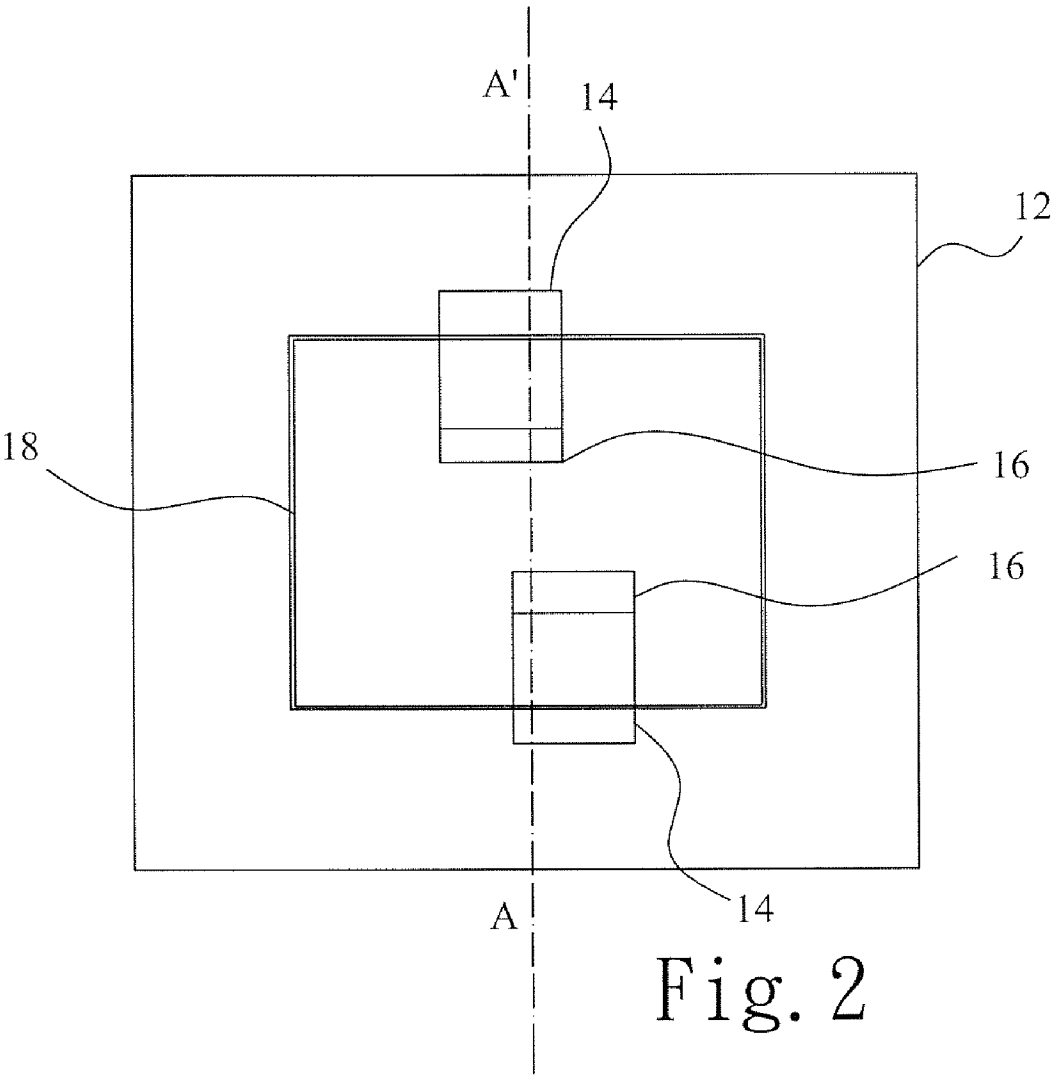
FIG. 2 is a lateral view showing the piezoelectric panel speaker according to an embodiment of the present invention.
Figure 3:
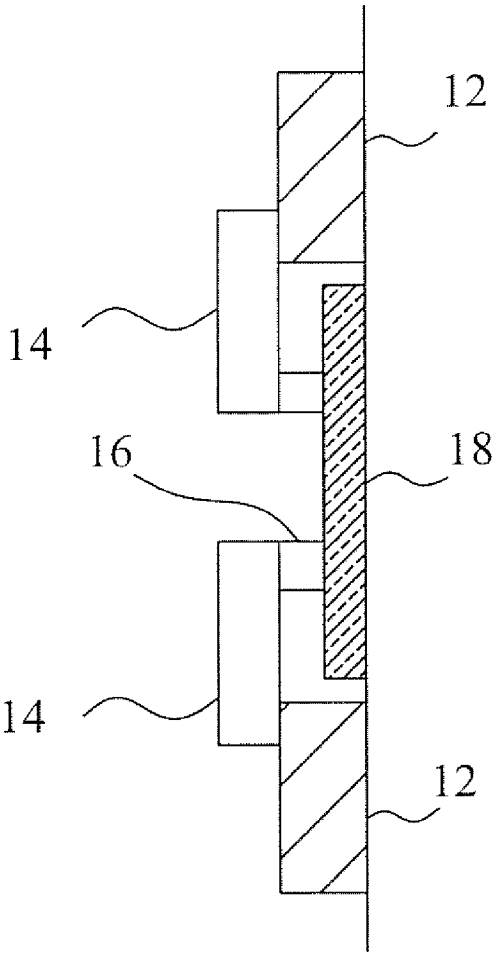
FIG. 3 is a sectional view showing the piezoelectric panel speaker according to an embodiment of the present invention.

Refer to FIG. 1-FIG. 3. The present invention provides a piezoelectric panel speaker, wherein FIG. 3 is a sectional view along a line of A-A' in FIG. 2. A piezoelectric panel speaker 10 comprises a hollow surrounding frame 12 and at least one piezoelectric plate 14 extending toward the inner of the surrounding frame 12. The embodiment is exemplified by two piezoelectric plates 14. An end of the piezoelectric plate 14 is fixed at the surrounding frame 12 and another end of the piezoelectric plate 14 is connected to a diaphragm 18 through a spacer 16 having a small area whereby the diaphragm 18 is fixed inside the surrounding frame 12. The surface area that the spacer 16 contacts the diaphragm 18 is less than or equal to the surface area of the piezoelectric plates 14. Firstly, the piezoelectric plates 14 receive a voltage and vibrate due to the piezoelectric effect. Then, the acoustic wave is induced and passed through the diaphragm 18 such that the piezoelectric panel speaker possesses the frequency response property.

The diaphragm comprises, for example, polyethylene terephthalate (PET), polycarbonate resin (PC), carbon fiber, metal, paper, glass fiber, etc. Other materials suitable for the diaphragm are within the scope of the present invention. In this embodiment of the present invention the material of the piezoelectric plate 14 is lead zirconate titanate (PZT) and the piezoelectric coefficient of the piezoelectric plate 14 is d33. A sealant is disposed between the diaphragm and the surrounding frame for sealing. In this embodiment the sealant is an adhesive tape. In other embodiments of the present invention adopts other sealant for sealing the diaphragm and the surrounding frame.

Figure 4:
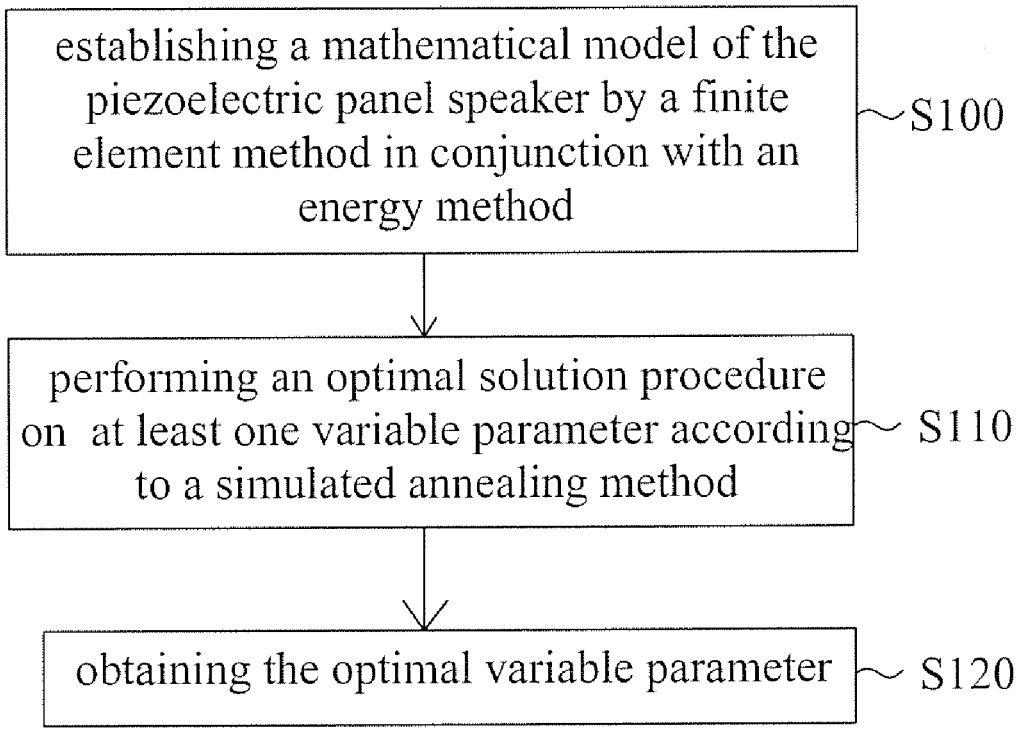
FIG. 4 is a flow chart of the optimal method of designing the piezoelectric panel speaker according to an embodiment of the present invention.

The present invention provides an optimal method of designing the piezoelectric panel speaker according to the above-mentioned piezoelectric panel speaker. The purpose of the optimal method is to design a piezoelectric panel speaker having an optimal frequency response. As shown in FIG. 4, in Step S100 a mathematical model of a piezoelectric panel speaker is established by a finite element method in conjunction with an energy method, wherein the mathematical model adopts different variable parameters which are used to design the piezoelectric panel speaker structure. The variable parameters comprise a relative position of the surrounding frame, the spacer, the piezoelectric plate, and the diaphragm, and a size, a material density, and a displacement of the spacer, or the piezoelectric plate. As long as the motion condition of the piezoelectric panel speaker having different specifications is simulated, a sound pressure loading of the piezoelectric panel speaker is evaluated by the mathematical model having at least one variable parameter. Then, in Step S110, an optimal solution procedure is performed on the variable parameter according to a simulated annealing method. Finally, in Step S120, the optimal solution of the variable parameter is obtained and the sound pressure loading of the optimal piezoelectric panel speaker is predicted through the mathematical model.

Figure 5:
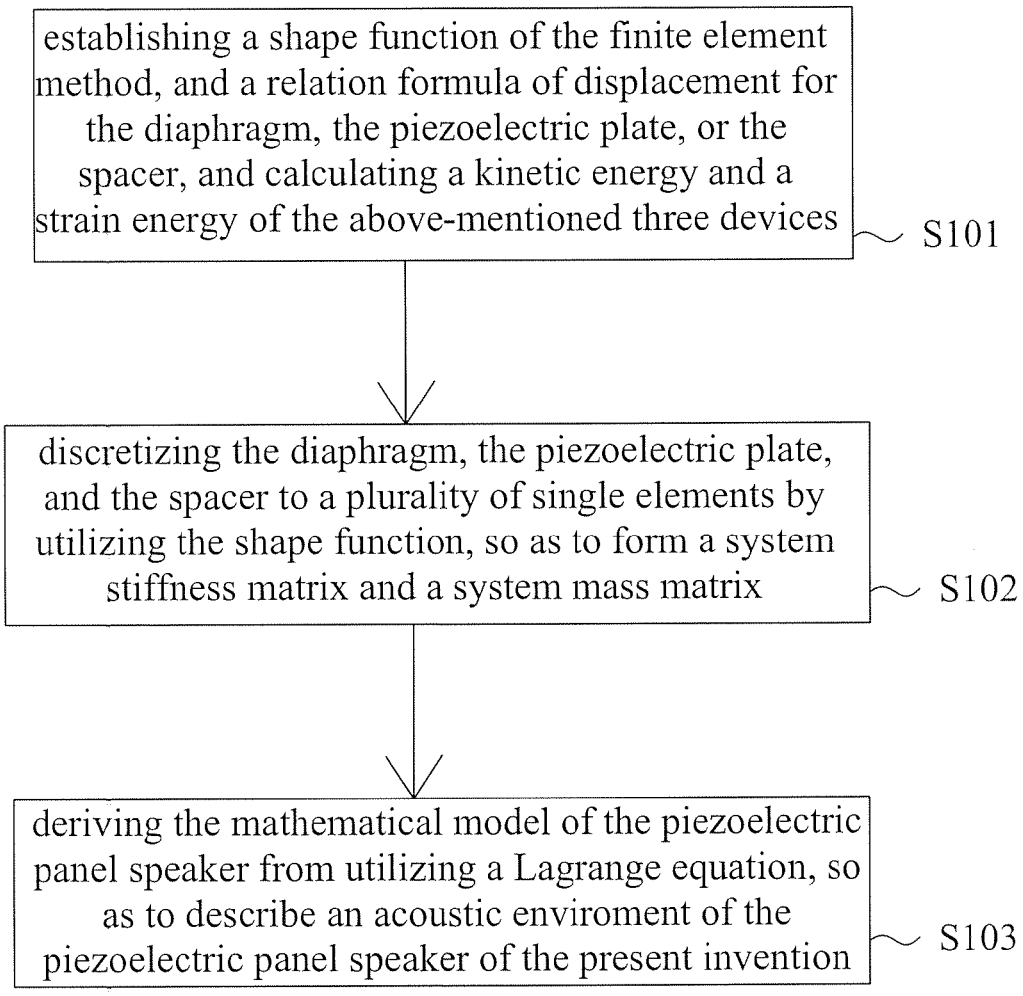
FIG. 5 is a flow chart of establishing the mathematical model of the piezoelectric panel speaker according to an embodiment of the present invention.

Refer to FIG. 5, which is a detailed flow chart of Step S100. Firstly, in Step S101, a shape function of the finite element method and a relation formula of displacement for the diaphragm, the piezoelectric plate, or the spacer are established, and a kinetic energy and a strain energy of the diaphragm, the piezoelectric plate, and the space are evaluated. Then, in Step S102, the diaphragm, the piezoelectric plate, and the spacer are discretized into a plurality of single elements by utilizing the shape function so as to form a system stiffness matrix and a system mass matrix. Finally, in Step S103, the mathematical model of the piezoelectric panel speaker is derived by utilizing a Lagrange equation so as to simulate an acoustic environment of the piezoelectric panel speaker of the present invention.

Figure 6:
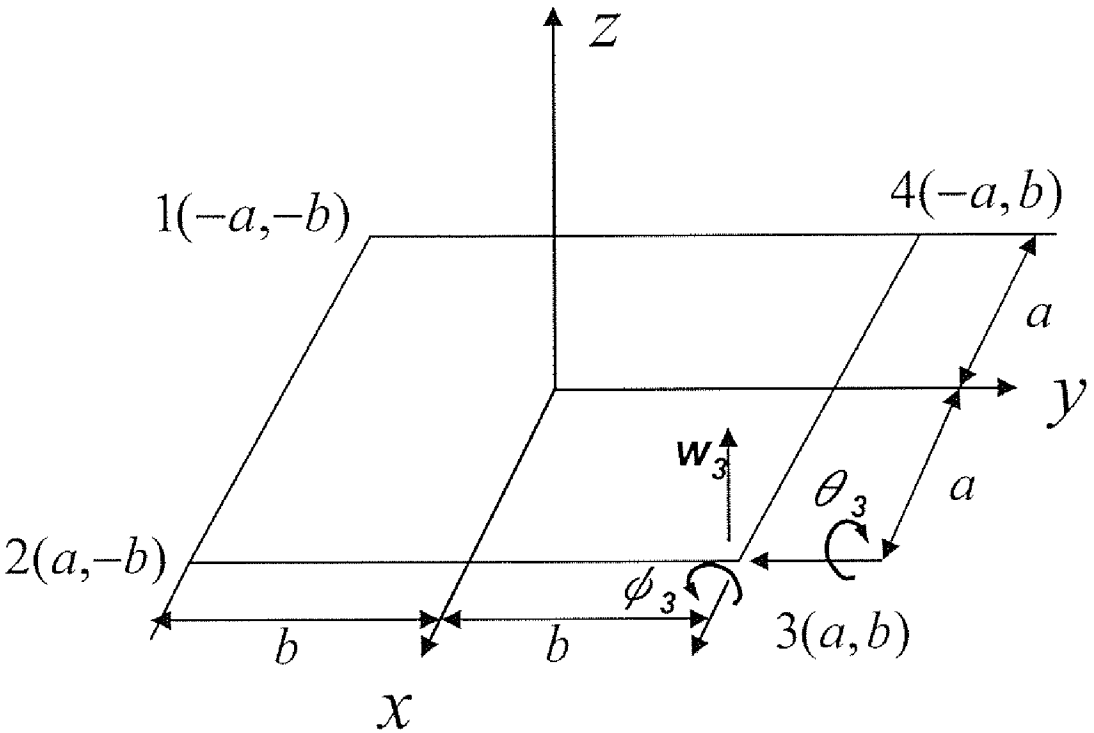
FIG. 6 is a diagram showing a single element for the finite element method according to an embodiment of the present invention.

The present invention further provides an embodiment to explain how the mathematical model of the embodiment is established by the finite element method. The present invention establishes a relation formula for a shape function and a displacement of a two-dimensional finite element method, wherein the lateral displacement w interpolated by cubic polynomials of physical coordinates in the finite element method is expressed as an equation (1):

$$w=x^T a \tag{1}$$

where $x=[1, x, y, x^2, xy, y^2, x^3, x^2y, xy^2, y^3, x^3y, xy^3]^T$ is the physical coordinate vector, and $a=[a_1, a_2, a_3, a_4, a_5, a_6, a_7, a_8, a_9, a_{10}, a_{11}, a_{12}]^T$ is the coefficient of the physical coordinate vector. As shown in FIG. 6, each single element is of length 2*b* and width 2*a*. The degrees of freedom of the element are grouped into a vector $d=[w_1, \theta_1, w_2, \theta_2, \phi_2, w_3, \theta_3, \phi_3, w_4, \theta_4, \phi_4]^T$, where $w_i$ (i=1, 2, 3, 4) is a lateral deflection, and $$\frac{\partial w_i}{\partial x} = \theta_i,$$

$$\frac{\partial w_i}{\partial y} = \phi_i$$

are rotations. To express the $a_j$, j=1, 2 . . . , 12 in terms of the physical ordinates and the slopes at four corners, let $w_i$, $$\frac{\partial w_i}{\partial x} = \theta_i,$$

$$\frac{\partial w_i}{\partial x} = \phi_i,$$

and i=1, 2, 3, 4, in equation (1). And then an equation (2) is obtained.

$$d=Ta,\ a=T^{-}d \tag{2}$$

Inserting equation (2) into equation (1) leads to an equation (3):

$$w=x^T T^{-1} d=Nd \tag{3}$$

where the shape function matrix of the finite element N can be identified as an equation (4):

$$N=x^T T^{-1} \tag{4}$$

Substituting the equation (3) into the internal energy $U_z$ of the piezoelectric plate leads to an equation (5). The internal energy of the piezoelectric plate is expressed in matrix:

$$U_z = I_1 D^T K_1 D + I_2 D^T K_2 D + I_3 D^T K_3 D + I_4 D^T K_4 q + I_5 q^2 - I_6 D^T K_6 D \tag{5}$$

where $$I_1 = c_{11}^D (z_4^3 - z_3^3)/6,\ I_2 = c_{11}^D (z_4^3 - z_3^3)/6,$$

$$I_3 = c_{12}^D (z_4^3 - z_3^3)/6,\ I_4 = h_{11}(z_4^2 - z_3^3)/2A_e,$$

$$I_5 = \beta_{33}(z_4 - z_3)/2A_e,\ I_6 = 2\beta_{66}^D (z_4^3 - z_3^3)/3,$$

$$K_1 = \sum_{n=1}^{s} \int_{-b}^{b}\int_{-a}^{a} B_1^T B_1\, dx\, dy,\ w_{xx} = B_1 d,\ B_1 = \frac{\partial^2 N}{\partial x^2},$$

$$K_2 = \sum_{n=1}^{s} \int_{-b}^{b}\int_{-a}^{a} B_2^T B_2\, dx\, dy,\ w_{yy} = B_2 d,\ B_2 = \frac{\partial^2 N}{\partial y^2},$$

$$K_3 = \sum_{n=1}^{s} \int_{-b}^{b}\int_{-a}^{a} B_1^T B_2\, dx\, dy,$$

$$K_4 = \sum_{n=1}^{s} \int_{-b}^{b}\int_{-a}^{a} (B_1 + B_2)^T\, dx\, dy,$$

$$K_6 = \sum_{n=1}^{s} \int_{-b}^{b}\int_{-a}^{a} B_5^T B_2\, dx\, dy,\ w_{xy} = B_5 d,\ B_2 = \frac{\partial^2 N}{\partial y^2},$$

$$D = \sum_{n=1}^{s} d,$$

where s is the total number of elements, $D_3 = q/A_e$, q is the electric charge on the electrodes, $A_e$ is the area of each element, D is the system stiffness matrix, and $\beta_{33}^s$, $h_{31}$, $C_{11}^D$, $C_{12}^D$, $C_{66}^D$ are the material coefficients of piezoelectric plate.

By the same token, the total strain energy and kinetic energy of the diaphragm, the piezoelectric plates and the spacers can be expressed as an equation (6) and an equation (7):

$$U_T = I_1 D^T K_1 D + I_2 D^T K_2 D + I_3 D^T K_3 D + I_4 D^T K_4 q + I_5 q^2 - I_6 D^T K_6 D + \frac{1}{2} D^T K_8 D \tag{6}$$

$$T_T = \frac{1}{2}\rho_p \dot{D}^T M_p \dot{D} + \frac{1}{2}\rho_s \dot{D}^T M_s \dot{D} + \frac{1}{2}\rho_z \dot{D}^T M_z \dot{D} \tag{7}$$

The relevant symbols in the equation (6)-(7) are defined as follows:

$$\dot{D} = dD/dt,\ K_7 = \int_{-b}^{b}\int_{-a}^{a} B_7^T D_{kp} B_7\, dx\, dy,$$

$$K_8 = \int_{-b}^{b}\int_{-a}^{a} (B_7^T D_{ks} B_7)\, dx\, dy,\ B_7 = [\, B_1 \quad B_2 \quad 2B_3 \,],$$

$$M_p = M_s = M_z = \int_{-b}^{b}\int_{-a}^{a} N^T N\, dx\, dy,$$

$$D_{kp} = \begin{bmatrix} D_p & v_p D_p & 0 \\ v_p D_p & D_p & 0 \\ 0 & 0 & \frac{(1 - v_p)}{2} D_p \end{bmatrix},\ \text{and}$$

-continued $$D_{ks} = \begin{bmatrix} D_s & v_s D_s & 0 \\ v_s D_s & D_s & 0 \\ 0 & 0 & \frac{(1 - v_s)}{2} D_s \end{bmatrix}.$$

where $D_p$ is the bending stiffness of the diaphragm, $D_s$ is the bending stiffness of the spacers, and $M_p$, $M_s$, and $M_z$ are the mass matrixes of the diaphragm, spacers, and piezoelectric plates. Therefore, when the equation (3) is discretized by the equation (6) and the equation (7), the total energy of the system is discretized into a plurality of single elements. And then, the stiffness matrix and the mass matrix of the single element are obtained.

The virtual work is done by the external force f, which is written as an equation (8):

$$\delta W_{vir} = \delta D^T f + v_z \delta q \tag{8}$$

where $$f = \sum_{n=1}^{s} \int_{-b}^{b}\int_{-a}^{a} (x, y, t)\, dx\, dy,$$

and $$v_z = \sum_{n=1}^{s} \int_{-b}^{b}\int_{-a}^{a} v_z(t)\, dx\, dy.$$

And the Lagrange equation is written as an equation (9), wherein $L = U_T - T_T$.

$$\begin{cases} \frac{d}{dt}\left(\frac{\partial L}{\partial \dot{D}^T}\right) - \frac{\partial L}{\partial D^T} = f \\ -\frac{\partial L}{\partial q} = v_z \end{cases} \tag{9}$$

Therefore, the mathematical model of the piezoelectric panel speaker of the present invention, which is written as an equation (10), is obtained.

$$\begin{cases} \begin{bmatrix} (\rho_p M_p + \rho_s M_s + \rho_z M_z)\omega^2 - 2I_1 K_1 - \\ 2I_2 K_2 - 2I_3 K_3 + 2I_6 K_6 - K_7 - K_8 \end{bmatrix} D - I_4 K_4 q = f \\ -I_4 K_4^T D - 2I_5 q = v_z \end{cases} \tag{10}$$

Wherein $\rho_p$, $\rho_s$, and $\rho_z$ are densities of the diaphragm, the spacer, and the piezoelectric plate, respectively. $M_p$, $M_s$, and $M_z$ are the mass matrixes of the diaphragm, the spacer, and the piezoelectric plate, respectively. D is the system stiffness matrix, $\dot{D} = v = j\omega D$, and $\ddot{D} = -\omega^2 D$.

The optimal method of designing the piezoelectric panel speaker of the present invention further considers that a radiation impedance of the speaker exists. The radiation impedance is relative to the estimated pressure vector p and speed vector v at a point on a surface of the speaker, and a radiation impedance matrix Z, which is written as an equation (11):

$$p = Zv \tag{11}$$

For a baffled planar radiator, the radiation impedance matrix Z is discretized in order to be obtained. Hence, the external force f is expressed by the sound pressure vector p, which is written as an equation (12):

$$f=A_e p=A_e Zv=jwA_e ZD \tag{12}$$

The optimal method of designing the piezoelectric panel speaker of the present invention adopts the proportional damping to calculate a damping matrix C of the piezoelectric panel speaker of the present invention, as shown by an equation (13):

$$C=\alpha M_d+\beta K_d \tag{13}$$

wherein α and β are constants, $M_d$ and $K_d$ denote the mass matrix and the stiffness matrix, as shown by an equation (14) and an equation (15), respectively.

$$M_d=2I_5(\rho_p M_p+\rho_s M_S+\rho_z M_z) \tag{14}$$

$$K_d=2I_5(-2I_1K_1-2I_2K_2-2I_3K_3+2I_6K_6-K_7-K_8)+I_4K_4K_4^T \tag{15}$$

Incorporating the damping matrix C into the equation (10) enables rewriting the displacement vector D as an equation (16):

$$D=-I_4(K+j\omega C)^{-1}K_4 v_z \tag{16}$$

where $$K=2I_5\begin{bmatrix}(\rho_p M_p+\rho_s M_s+\rho_z M_z)\omega^2-2I_1K_1-2I_2K_2-\\ 2I_3K_3+2I_6K_6-K_7-K_8-j\omega A_e Z\end{bmatrix}+I_4K_4K_4^T$$

After evaluation, the radiated sound pressure is $p_f$=Ev, where $p_f$ is the radiated sound pressure vector, and v is the surface velocity vector that can be evaluated by differentiating displacements D. For the baffled planar radiator, a sound pressure loading matrix E is written as an equation (17):

$$E=j\frac{\rho_0 c_s k A_e}{2\pi}\begin{bmatrix}\frac{e^{-jkr_{11}}}{r_{11}} & \frac{e^{-jkr_{12}}}{r_{12}} & \cdots & \frac{e^{-jkr_{1n}}}{r_{1n}}\\ \frac{e^{-jkr_{21}}}{r_{21}} & \frac{e^{-jkr_{22}}}{r_{22}} & \cdots & \frac{e^{-jkr_{2n}}}{r_{11}}\\ \vdots & \vdots & \ddots & \vdots\\ \frac{e^{-jkr_{m1}}}{r_{m1}} & \frac{e^{-jkr_{m2}}}{r_{m2}} & \cdots & \frac{e^{-jkr_{mn}}}{r_{mn}}\end{bmatrix} \tag{17}$$

where $A_e$ is the area of the element and $r_{mn}$ is the distance between a microphone m and each element n where n and m are both positive integers. Therefore, for the piezoelectric panel speaker, the curve of sound pressure versus frequency is evaluated by the sound pressure loading matrix E.

Figure 7:
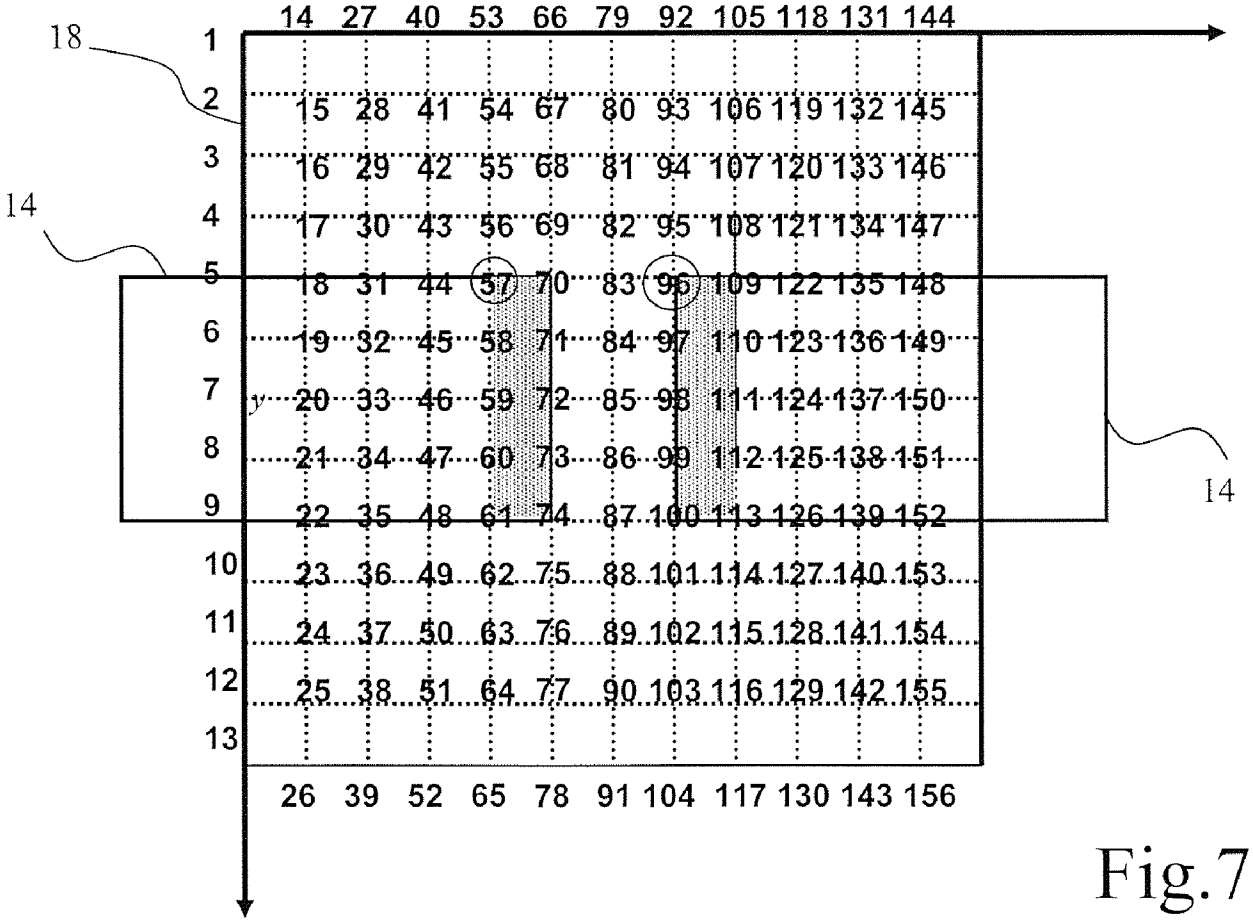
FIG. 7 is a diagram illustrating a complete mesh for a diaphragm according to an embodiment of the present invention.
Figure 8:
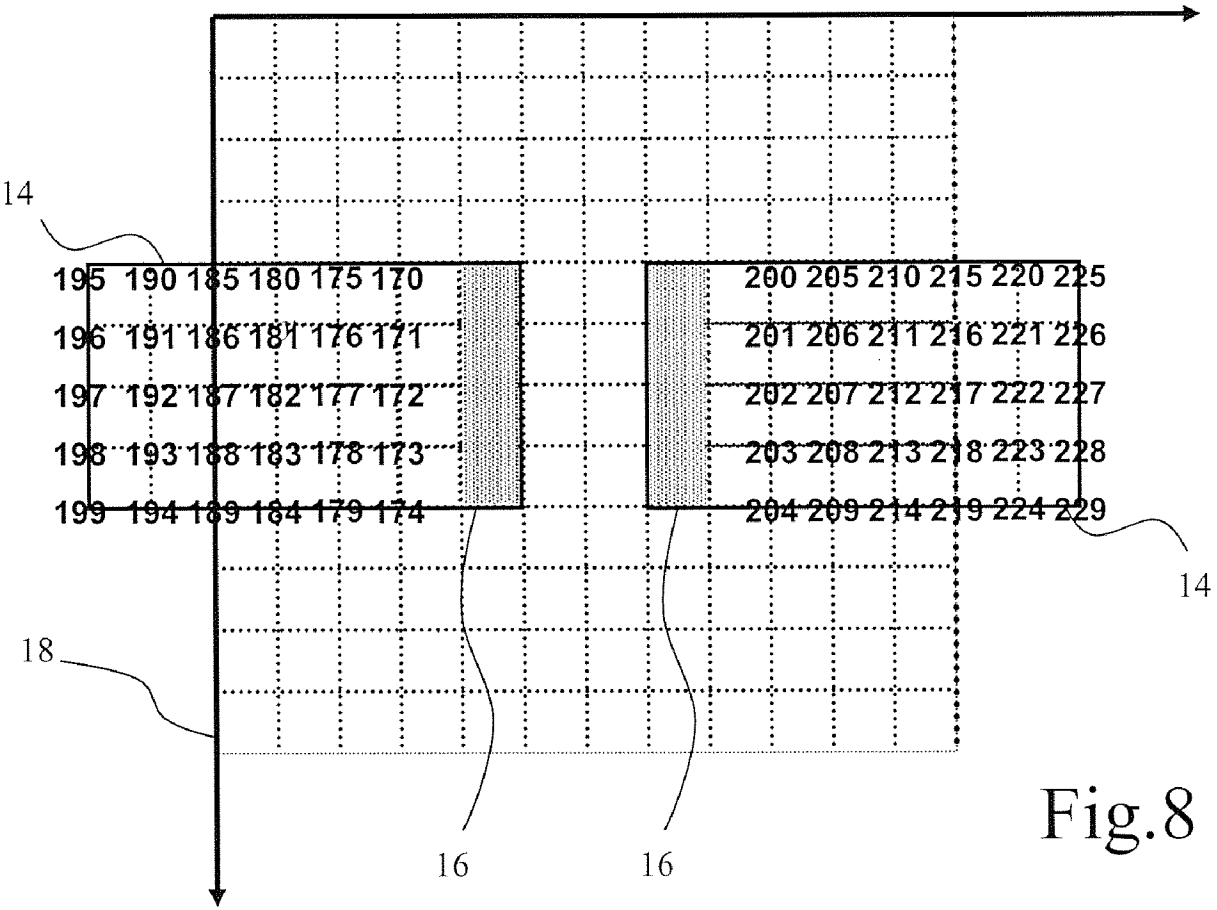
FIG. 8 is a diagram illustrating a complete mesh for a piezoelectric plate according to an embodiment of the present invention.

The present invention provides an embodiment of an optimal solution procedure for the piezoelectric panel position in the piezoelectric speaker by the optimal method of designing the piezoelectric speaker. Firstly, the piezoelectric panel position relative to the diaphragm is set to be used as the variable parameter whereby the mathematical model of the present invention is established. Then, refer to FIG. 7. Before optimizing the variable parameter, upper-left corners of the two spacers 16 serve as base corners which are located on the diaphragm positions of 57 and 96 respectively. As shown in FIG. 8, the diaphragm is discretized into 144 elements by the finite element method and the piezoelectric panel is discretized into 56 elements. Also, the material parameters of the diaphragm, the piezoelectric panel, and the spacer used in the mathematical model are shown in Table 1.

TABLE 1

| | Material | Parameter | Value |
|---|---|---|---|
| Diaphragm | Polycarbonate (PC) | size | 0.06 m × 0.06 m × 0.000254 m |
| | | density | 1200 kg/m$^3$ |
| | | Young's modulus | 7 GPa |
| | | Poisson's ratio | 0.37 |
| Spacer | Polycarbonate (PC) | size | 0.005 m × 0.035 m × 0.000254 m |
| | | density | 1200 kg/m$^3$ |
| | | Young's modulus | 7 Gpa |
| | | Poisson's ratio | 0.37 |
| Piezoelectric plate | Lead zirconate titanate(PZT) | size | 0.02 m × 0.035 m × 0.002 m |
| | | density | 7800 kg/m$^3$ |
| | | $\beta_{33}^s$ | 3.52 × 10$^7$ |
| | | $h_{31}$ | −3.6772 × 10$^8$ v/m |
| | | $C_{11}^D$ | 12.236 × 10$^{10}$ N/m$^2$ |
| | | $C_{12}^D$ | 5.244 × 10$^{10}$ N/m$^2$ |
| | | $C_{66}^D$ | 3.496 × 10$^{10}$ N/m$^2$ |

Figure 9:
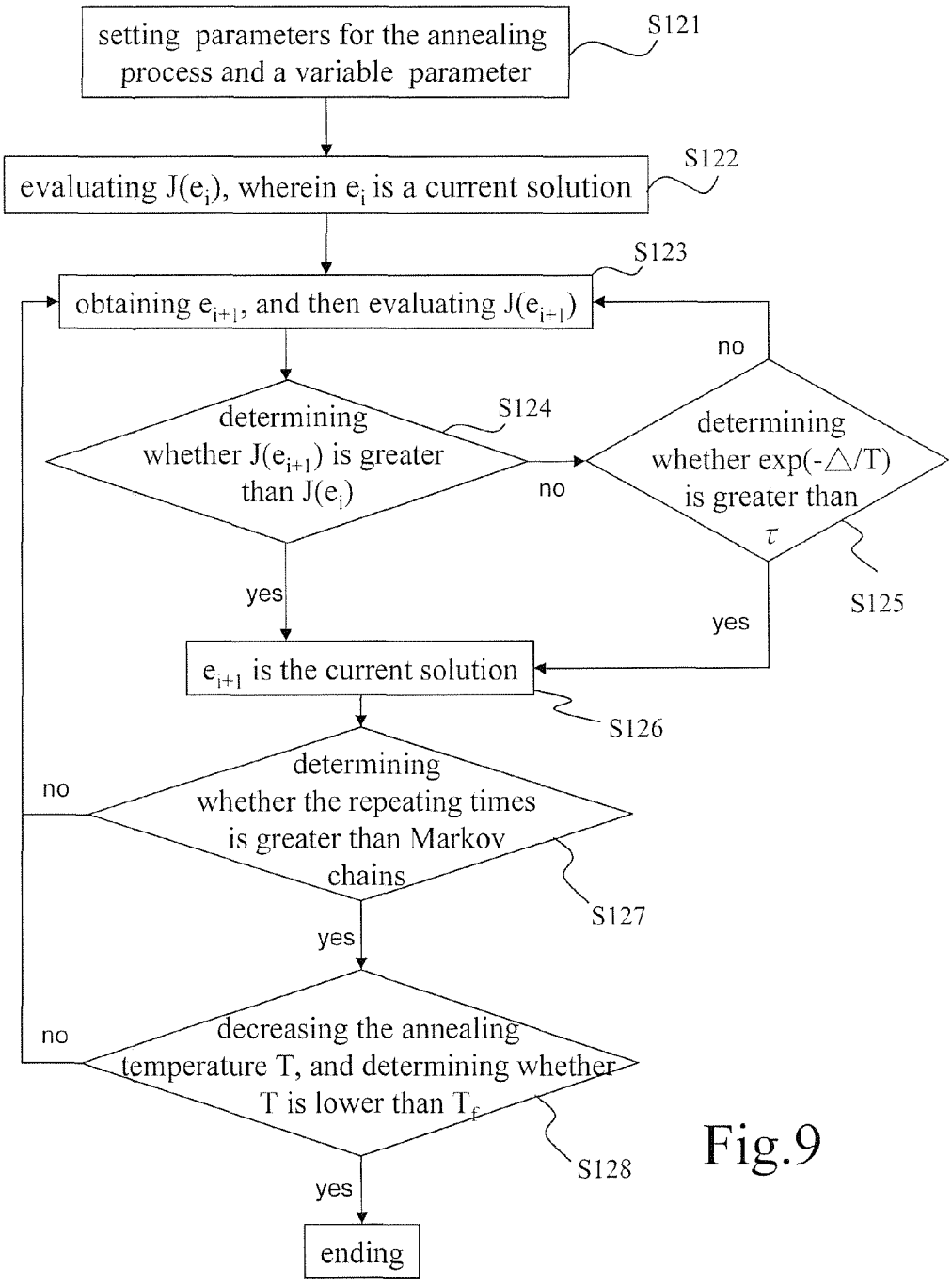
FIG. 9 is a flow chart of an optimal solution procedure by utilizing a simulated annealing method according to an embodiment of the present invention.

Therefore, the sound pressure loading of the panel speaker is simulated by the mathematical model of the panel speaker. Then, the solution of the variable parameter is found by a simulated annealing method. Refer to FIG. 9, the simulated annealing method can be summarized as follows.

(1) In Step S121, the parameters for the annealing process and the variable parameters $e_i$, $e_i=e_i(e_1, e_2, \ldots, e_n)$ are set. The initial state of the predetermined variable parameters is that the two piezoelectric plates are located on the diaphragm positions of 57 and 96 respectively. The parameters for the annealing process are shown in Table 2:

TABLE 2

| Parameter | Value |
|---|---|
| Initial temperature, $T_0$ | 10 |
| Final temperature, $T_f$ | $10^{-9}$ |
| Markov chains | 4 |
| Temperature reduction rate | 0.85 |

(2) In Step S121, a goal function $J(e_i)$ of the variable parameters $e_i$ is evaluated, wherein the goal function is expressed as an equation (18):

$$J=\frac{10^{(P_{avg}-94)/20}}{f_0}\times 10000 \tag{18}$$

wherein $f_0$ is a fundamental frequency whose sound pressure loading is greater than 40 dB; $P_{avg}$ is an average sound pressure loading which is greater than $f_0$ and $e_i$ is a current solution.

(3) In Step S123, perturb $e_i$ to obtain neighboring parameter $e_{i+1}$ and evaluate $J(e_{i+1})$.

(4) In Step S124, determine whether $J(e_{i+1})$ is larger than $J(e_i)$. If the answer is yes, the process proceeds to Step S126. If the answer is no, the process proceeds to Step S125. In Step S125, decide whether $e_i$ is replaced with $e_{i+1}$ used as the current solution according to whether a success probability exp(−Δ/T) is greater than τ. If the answer is yes, the process proceeds to Step S126. If the answer is no, the process returns to Step S123. Δ is a difference in value between goal function values of the new solution $e_{i+1}$ and the old solution $e_i$; $\tau$ is a random number in a interval of [0,1]; and T is an annealing temperature.

(5) In Step S126, $e_i$ is replaced with $e_{i+1}$ used as the current solution, and then the next step is executed.

(6) In Step S127, determine whether the repeating time is greater than Markov chains. If the answer is yes, the process proceeds to the next step. If the answer is no, the process returns to Step S123.

(7) In Step S128, decrease the annealing temperature T and determine whether the annealing temperature T is lower than the final temperature $T_f$. If the answer is yes, the process proceeds to end the annealing process. If the answer is no, the process returns to Step S123 so as to continue finding the optimal solution.

Figure 10:
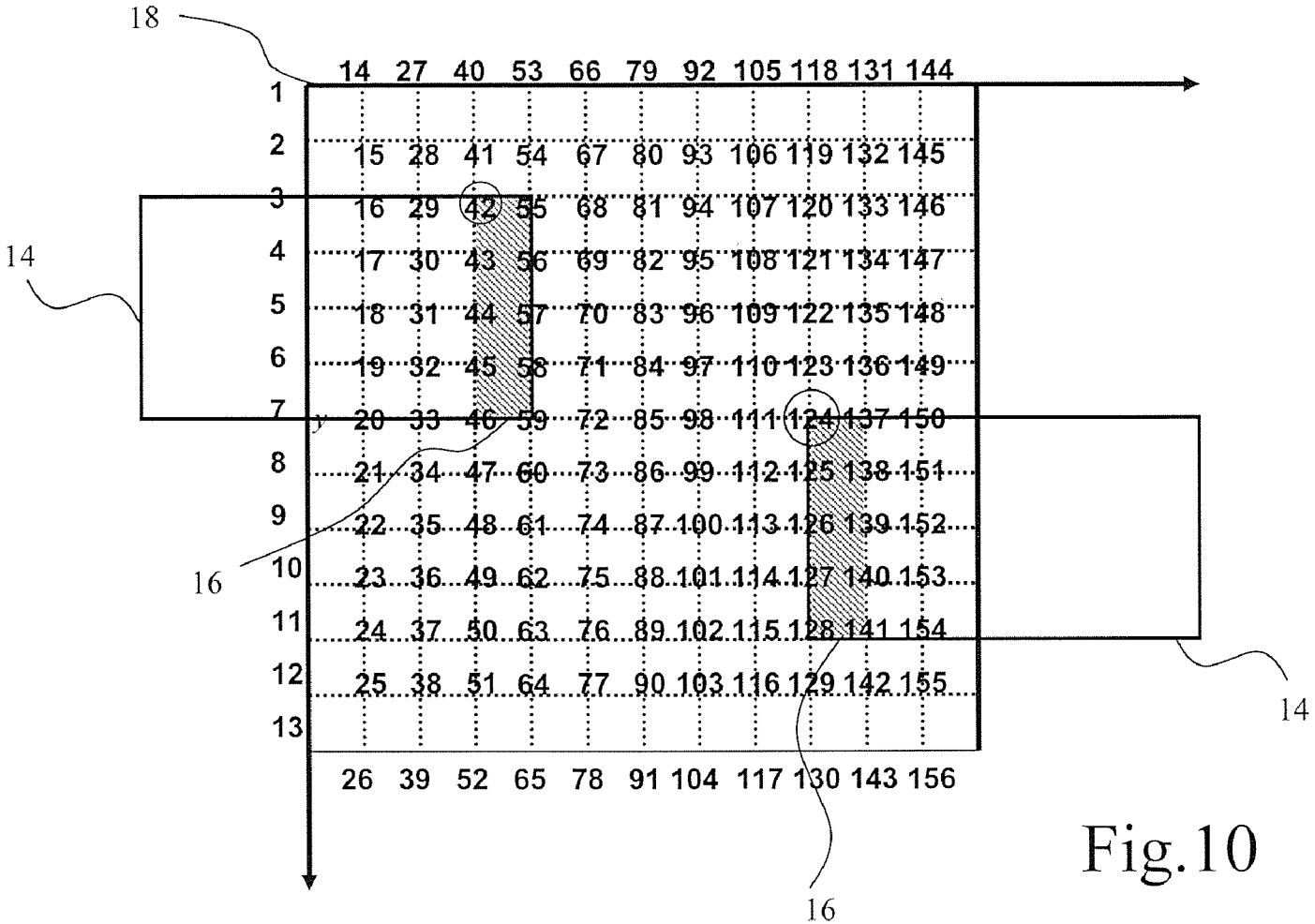
FIG. 10 is a diagram illustrating the relative relation between the optimal piezoelectric plate and the diaphragm according to an embodiment of the present invention.
Figure 11:
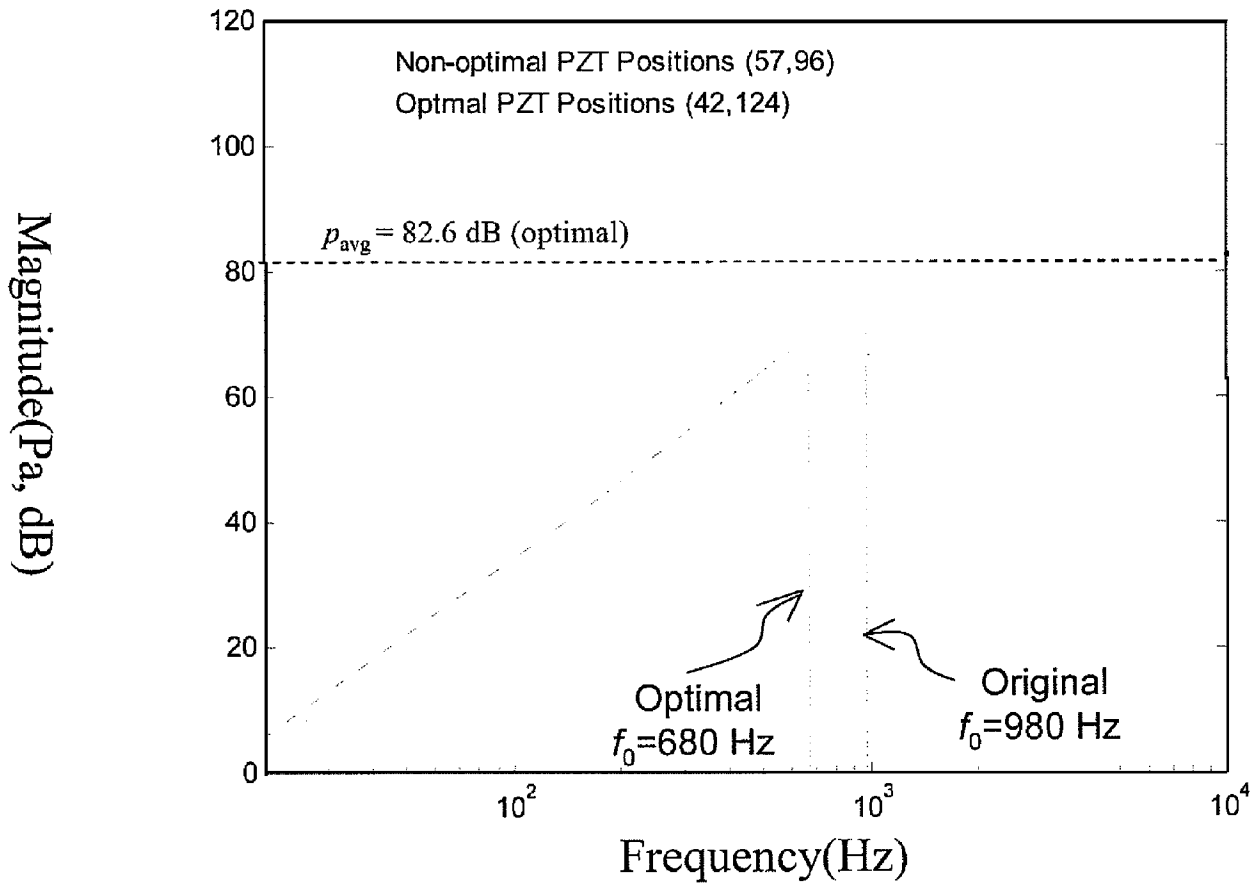
FIG. 11 is a diagram illustrating the sound pressure level of the non-optimal and optimal piezoelectric panel speaker according to an embodiment of the present invention.

After the annealing process, the optimal variable parameter is obtained. In this embodiment the physical meaning of the optimal variable parameter is that the upper-left base corners of the spacer 16 are respectively located on the diaphragm positions of 42 and 124 as shown in FIG. 10. Refer to FIG. 11 which illustrates a graph comparing non-optimal piezoelectric plate positions and optimal piezoelectric plate positions with the sound pressure level of the piezoelectric panel speaker. As shown in FIG. 11, the fundamental frequency has been reduced with the optimal design by approximately 300 Hz and the average sound pressure level is 82.6 dB. The present invention also adopts one variable parameters or a plurality of variable parameters to perform the optimal mathematical calculation for the simulated annealing method. For example, the position, the geometrical shape, and the material change for at least one piezoelectric plate.

In conclusion, the present invention discloses a piezoelectric panel speaker and an optimal design method of designing the same, wherein at least one cantilever piezoelectric plate of the piezoelectric panel speaker is fixed at the surrounding frame and supports a diaphragm inside the surrounding frame. This kind of speaker structure improves the sound magnitude and sound quality within the low-frequency range. Also, the present invention further provides an optimal method of the designing piezoelectric panel speaker. Firstly, a mathematical model is established by the finite element method in conjunction with the energy method so as to predict the sound pressure loading of the piezoelectric panel speaker. Then, the optimal parameter is obtained by the simulated annealing method automatically. The optimal method is used as the reference for fabricating the speaker whereby the speaker is more efficiently designed by a skilled person in the art. Moreover, the optimal design method of the piezoelectric panel speaker of the present invention is further applied to design a similar speaker structure.

The embodiments described above are only to exemplify the present invention but not to limit the scope of the present invention. Therefore, any equivalent modification or variation according to the shape, structures, characteristics and spirit disclosed in the present invention is to be also included within the scope of the present invention.

What is claimed is:

1. An optimal method of designing a piezoelectric panel speaker comprising steps of:

establishing at least one piezoelectric plate with a first end fixedly coupled to an interior portion of a surrounding frame of the piezoelectric panel speaker;

establishing a diaphragm disposed inside the surrounding frame;

establishing a mathematical model of the piezoelectric panel speaker by a finite element method in conjunction with an energy method;

evaluating a sound pressure loading of the piezoelectric panel speaker by using the mathematical model which comprises at least one variable parameter;

performing an optimal solution procedure on the variable parameter according to a simulated annealing method;

obtaining optimal variable parameter corresponding to the piezoelectric panel speaker having an optimal sound pressure loading;

positioning a spacer on the diaphragm based on the obtained optimal variable parameter; and coupling the spacer between a second end of said piezoelectric plate and the diaphragm.

2. The optimal method of designing the piezoelectric panel speaker according to claim 1, wherein the variable parameter is a relative position, a size, a material properties like stiffness, density, or a various materials of the surrounding frame, the spacer, the piezoelectric plate, or the diaphragm.

3. The optimal method of designing the piezoelectric panel speaker according to claim 1, wherein the step of establishing the mathematical model of the piezoelectric panel speaker by the finite element method in conjunction with the energy method further comprises steps of:

establishing a shape function of the finite element method, and a relation formula of displacement for the diaphragm, the piezoelectric plate, or the spacer, and calculating a kinetic energy and a strain energy of the diaphragm, the piezoelectric plate, and the spacer;

discretizing the diaphragm, the piezoelectric plate, and the spacer into a plurality of single elements by utilizing the shape function so as to form a system stiffness matrix and a system mass matrix; and deriving the mathematical model of the piezoelectric panel speaker by utilizing a Lagrange equation.

4. The optimal method of designing the piezoelectric panel speaker according to claim 3, wherein the sound pressure loading is expressed as:

$$E = j\frac{\rho_0 c_s k A_e}{2\pi}\begin{bmatrix} \frac{e^{-jkr_{11}}}{r_{11}} & \frac{e^{-jkr_{12}}}{r_{12}} & \cdots & \frac{e^{-jkr_{1n}}}{r_{1n}} \\ \frac{e^{-jkr_{21}}}{r_{21}} & \frac{e^{-jkr_{22}}}{r_{22}} & \cdots & \frac{e^{-jkr_{2n}}}{r_{11}} \\ \vdots & \vdots & \ddots & \vdots \\ \frac{e^{-jkr_{m1}}}{r_{m1}} & \frac{e^{-jkr_{m2}}}{r_{m2}} & \cdots & \frac{e^{-jkr_{mn}}}{r_{mn}} \end{bmatrix}$$

wherein E is the sound pressure loading; rmn is a distance between a microphone and each element; n and m are both positive integers; Ae is an area of each element; and Pf is a sound pressure vector.

5. The optimal method of designing the piezoelectric panel speaker according to claim 1, wherein the step of performing the optimal solution procedure on the variable parameter according to the simulated annealing method further comprises steps of:

setting an annealing process;

starting the annealing process to determine whether an old solution is replaced with a new solution used as a current superior solution by a goal function or a variation success probability; and ending the annealing process.

6. The optimal method of designing the piezoelectric panel speaker according to claim 5, wherein in the step of setting the annealing process, an initial annealing temperature, a final annealing temperature, an annealing speed, or the variable parameter are all set.

7. The optimal method of designing the piezoelectric panel speaker according to claim 5, wherein the step of determining whether the old solution is replaced with the new solution used as the current superior solution is executed according to whether the variation success probability $\exp(-\Delta/T)$ is greater than $\tau$; wherein $\Delta$ is a difference in value between goal function values of the new solution and the old solution; $\tau$ is a random number in a interval of [0,1]; and T is an annealing temperature.

8. The optimal method of designing the piezoelectric panel speaker according to claim 5, wherein the goal function is express as:

$$J = \frac{10^{(P_{avg}-94)/20}}{f_0} \times 10000;$$

wherein $f_0$ is a fundamental frequency, whose sound pressure is greater than 40 dB; and $P_{avg}$ is an average sound pressure, which is greater than $f_0$.

* * * * *